United States Patent [19]

Staudenmayer et al.

[11] 4,195,990

[45] Apr. 1, 1980

[54] ELECTROPHOTOGRAPHIC PAPERS EMPLOYING ORGANIC PHOTOCONDUCTORS

[75] Inventors: William J. Staudenmayer; Michael T. Regan; James A. Van Allan; William E. Yoerger, all of Rochester, N.Y.

[73] Assignee: Eastman Kodak Company, Rochester, N.Y.

[21] Appl. No.: 800,482

[22] Filed: May 25, 1977

[51] Int. Cl.[2] ..... G03C 5/04; G03C 5/09

[52] U.S. Cl. ..... 430/70; 430/75; 430/83

[58] Field of Search ..... 96/1.5, 1 PC, 1, 1.6; 252/267

[56] References Cited

U.S. PATENT DOCUMENTS

| | | | |
|---|---|---|---|
| 3,152,895 | 10/1964 | Tinker et al. | 96/1.5 |
| 3,281,240 | 10/1966 | Cassiers et al. | 96/1.5 |
| 3,287,123 | 11/1966 | Hoegl | 260/267 |
| 3,607,261 | 9/1971 | Amidon et al. | 96/1.5 |

FOREIGN PATENT DOCUMENTS 2150134 7/1971 Fed. Rep. of Germany .

*Primary Examiner*—J. Travis Brown
*Attorney, Agent, or Firm*—T. N. Dahl

[57] ABSTRACT

Electrophotographic papers comprising electrically conducting paper supports and photoconductive insulating compositions in the form of organic photoconductive dispersions are described. Particles of certain polyphenyl organic photoconductors with para-linked phenyl groups, or polyarylated unsaturated organic photoconductors are dispersed in cellulose nitrate to provide useful photoconductive insulating dispersions.

14 Claims, No Drawings

ELECTROPHOTOGRAPHIC PAPERS EMPLOYING ORGANIC PHOTOCONDUCTORS

BACKGROUND OF THE INVENTION

1. Field of the Invention

This invention relates to electrophotography. In particular, the invention relates to electrophotographic elements composed of electrically conducting paper supports and heterogeneous photoconductive compositions of dispersed organic photoconductor particles chemically sensitized with cellulose nitrate.

2. Discussion of Related Art

The process of xerography, as disclosed by Carlson in U.S. Pat. No. 2,297,691 (issued Oct. 6, 1942), employs an electrophotographic element comprising a conductive support material bearing a coating of a normally insulating material whose electrical resistance varies with the amount of incident electromagnetic radiation it receives during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor, or the like, or transferred to a second element to which it can similarly be fixed. Likewise, the electrostatic latent image can be transferred to a second element and developed there.

The present-day document copying field includes predominantly either what is known as "plain paper" high volume copying or low volume copying in which ultimate copies are presented on the electrophotographic element itself. The latter elements are often referred to as "coated paper materials". In plain paper copying, as noted above, marking material that is imagewise deposited on a photoconductive material is transferred to a second element, typically paper, thereby releasing the photoconductive material for further imaging, marking, and image transfer in cyclic fashion. Accordingly, each form of electrophotographic copying encompasses distinct objectives. For example, when copies are provided on coated paper materials, the "feel", color, odor, weight etc., of the copy, not to mention the speed and quality of reproduction, are prime concerns. On the other hand, in plain paper copying, the aesthetic quality of the sensitive element is relatively unimportant compared to the plain paper copy derived therefrom. Normally, for example, the sensitive element in plain paper copying is not even seen by the user.

In the case at hand, however, focus is directed to the requirements of an electrophotographic element which is a coated paper electrophotographic element. Accordingly, the overall element should be light in weight, and the photoconductive layer thereon should be whitish in color. Furthermore, the photoconductive layer on the support for such element must be stable to the effects of normal storage and the copying process, such that the white color of the layer remains essentially unchanged both before and after copying. The coated paper element should also be non-glossy and immune to "coining" (the residual mark left when the edge of a coin is pressed against the drawn across the photoconductive surface). In other equally important respects, the overall "feel," so-to-speak, of the element should resemble that of ordinary bond paper. Moreover, the speed and quality with which copying is effected by such elements must be respectively reasonable and high.

Various photoconductive insulating materials have been employed in the manufacture of coated paper electrophotographic elements. For example, inorganic photoconductors such as particles of photoconductive zinc oxide held in resinous, film-forming binder have found wide application in the present-day document copying applications.

Since the introduction of electrophotography, a great many organic compounds have also been screened for their photoconductive properties. As a result, a very large number of organic compounds have been known to possess some degree of photoconductivity. Many organic compounds have revealed a useful level of photoconduction and have been incorporated into photoconductive compositions.

In photoconductive insulating compositions using organic photoconductors, the photoconductor, if not polymeric, is usually carried in a film-forming binder. Typical binders are polymeric materials having fairly high dielectric strength such as phenolic resins, ketone resins, acrylic ester resins, polystyrenes and the like. A more comprehensive listing of binders appears in U.S. Pat. Nos. 3,755,310 (issued Aug. 28, 1973 to L. J. Rossi) and 3,607,261 (issued Sept. 21, 1971 to A. B. Amidon et al). The photoconductor can be dissolved with the binder to prepare a homogeneous photoconductive composition in a common solvent. In another aspect, it can be provided as a dispersion of small particles in the binder to prepare a heterogeneous photoconductive composition. A general discussion of such dispersions and their preparation appears in U.S. Pat. No. 3,253,914 (issued May 31, 1966 to G. Schaum et al).

Organic photoconductors demonstrate widely varying degrees of solubility in the organic solvents used to dissolve many of the common binders. In the preparation of homogeneous photoconductive insulating compositions, organic photoconductors such as p-terphenyl and others of low solubility in popular solvents cannot usually be included in sufficient concentration to provide compositions of desirable light-sensitivity. It is particularly with organic photoconductors of lower solubility that dispersion techniques, such as those referred to previously, are used to provide heterogeneous photoconductive insulating compositions. By use of dispersion techniques higher photoconductor concentrations can be obtained, the objective being to improve light-sensitivity in the composition.

Coated paper electrophotographic elements comprising heterogeneous organic photoconductive layers as discussed herein can be advantageous. For example, they do not present the weight of elements using inorganic photoconductors like zinc oxide, and they can be prepared to resemble bond paper. However, in such applications, they have not enjoyed the popularity of photoconductive insulating compositions using inorganic photoconductors.

To date, with certain exceptions, the art has generally appeared to avoid the use of organic photoconductive materials in the manufacture of heterogeneous photoconductive compositions containing dispersions of photoconductive particles in a polymeric binder. It appears that efforts to formulate commercially acceptable heterogeneous photoconductive compositions using organic photoconductive particles have not been successful, owing to the inability of such compositions to exhibit both (a) acceptable photosensitivity comparable to conventional inorganic compositions, such as ZnO dispersions, and (b) the other desired colorant, physical and chemical properties which are necessary to provide a resultant composition having an appearance and properties similar to that of so-called "plain paper." For example, in U.S. Pat. No. 3,152,895 (issued Oct. 13, 1964 to G. H. Tinker et al) there is described a photoconductive composition comprising anthracene (as photoconductive pigment) and a resinous binder in an electrophotographic element. While anthracene is reasonably acceptable with regard to photoconductive speed, it is extremely unstable such that after periods of storage (e.g., 6 months to a year), it sublimes and turns yellow. Sublimation, of course, will ultimately result in decreased photoconductive speed.

It is known, furthermore, that the choice of binder can effect light sensitivity of a photoconductive insulating composition containing a photoconductor and a binder. See, for example, U.S. Pat. No. 3,703,372 (issued Nov. 21, 1972 to S. H. Merrill). This is considered especially true relative to heterogeneous photoconductive insulating compositions where the photoconductor is not in continuous phase solid solution and charge carriers must pass between photoconductor particles through any intervening, electrically insulating binder. The difficulty, of course, lies in the fact that there is no suggested means in the art for predicting which binders will favorably affect the light sensitivity of photoconductive insulating compositions which, in addition, fulfill all the other requirements for coated paper applications. Thus, for example, in the aforementioned U.S. Pat. Nos. 3,607,261 and 3,152,895, a variety of materials, including cellulose nitrate, are disclosed as equivalent binders for a variety of organic photoconductors in electrophotographic compositions. These patents, however, do not suggest the particular combination of properties which is achieved in electrophotographic elements having paper supports when cellulose nitrate is employed in admixture with the particular organic photoconductors hereinafter described.

SUMMARY OF THE INVENTION

In accordance with the invention, there are provided electrophotographic paper elements having heterogeneous photoconductive insulating compositions comprising particles of certain organic photoconductors in admixture with at least a sensitizing amount of cellulose nitrate. The organic photoconductor employed is either a polyphenyl having at least three para-linked phenyl groups, or a compound of the structure:

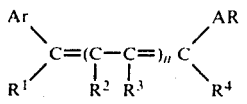

wherein:

n is a whole number from 0 to 2;

Ar is an aryl group including substituted aryl, such as phenyl, alkylphenyl having 1 to about 10 carbon atoms in the alkyl moiety, and alkoxyphenyl having 1 to about 10 carbon atoms in the alkoxy moiety;

each of $R^1$, $R^2$, $R^3$ and $R^4$ represents a hydrogen atom, an aryl group (for example as defined for Ar), an alkyl group having 1 to about 10 carbon atoms, an alkoxy group having 1 to about 10 carbon atoms and, when n is 0, both $R^1$ and $R^4$ are aryl and, when both $R^1$ and $R^4$ are hydrogen, both $R^2$ and $R^3$ are aryl.

The photoconductive insulating compositions of this invention are carried as layers on electrically conducting paper supports to provide coated paper electrophotographic elements that can be charged, exposed and developed by well-known electrophotographic methods. The photoconductive layer on such coated paper element can resemble bond paper, in both appearance and feel to bond paper. Furthermore, the weight and coining propensity of the coated paper elements of the present invention are respectively quite low, in contrast to many photoconductive papers using an inorganic species, such as a metal oxide, as the photoconductor. Further, (apparently because of the particulate nature of the photoconductive particles) the present elements can be usefully chemically or spectrally sensitized with low concentrations of sensitizer compounds as compared to the concentrations that may be required for elements composed of homogeneous organic photoconductive insulating compositions. This sensitization capability permits enhancement of the spectral response and electrophotographic speed of the particular photoconductor without detracting from the appearance of electrophotographic elements described herein.

Detailed Description of the Preferred Embodiments

In accordance with the invention, an electrophotographic paper element having a layer of a heterogeneous photoconductive composition comprising certain organic photoconductor particles in admixture with cellulose nitrate exhibits highly useful properties. In one sense the present composition exhibits improved photoconductivity compared to otherwise identical compositions having binder materials other than cellulose nitrate. In another aspect, the use of cellulose nitrate as binder in homogeneous photoconductive compositions has been observed to show no appreciable improvement in photoconductivity compared to homogeneous compositions containing other binders. The particulate nature of the present photoconductors in combination with cellulose nitrate represents, therefore, a significant part of the present invention.

Use of the above described organic photoconductors in the present electrophotographic element is particularly advantageous. In admixture with cellulose nitrate, particles of these photoconductors contribute to an overall element exhibiting improved photoconductivity, high stability to storage and processing, and a striking resemblance in both feel and texture to ordinary bond paper. Moreover, the resulting element is light in weight, whitish in color, and highly resistant to "coining."

Use of the present composition on a white conducting paper support, in a most preferred embodiment of the invention, provides an electrophotographic element which to the eye and touch of the ordinary user constitutes an acceptable substitute for plain white bond paper, having, in addition, all the advantages of electrophotographic reproduction described herein.

Polyphenyl compounds for making microcrystalline photoconductive particles include polyphenyl compounds wherein the phenylene groups are para-phenylene groups. Such compounds include, for example, p-terphenyl, p-quaterphenyl, and p-sexiphenyl. Especially preferred materials are co-crystalline photoconductors comprising p-terphenyl doped with p-quaterphenyl. Techniques for manufacturing such especially preferred photoconductors include, for example, dissolving p-terphenyl and p-quaterphenyl in a common solvent, and thereafter co-crystallizing the dissolved polyphenyls, as described in co-pending application U.S. Ser. No. 800,509 entitled CO-CRYSTALLINE PHOTOCONDUCTORS AND HETEROGENEOUS COMPOSITIONS THEREOF in the name of W. E. Yoerger filed concurrently herewith.

Preferred nitrogen-free, polyarylated photoconductors for use in this invention, are of the formula given above where n is one, and Ar, $R^1$, $R^2$, $R^3$ and $R^4$ are as described. Impurities in the photoconductor may affect its performance in compositions of the present type so that photoconductors of high purity are preferred. Polyarylated photoconductors of this type are described in allowed U.S. patent application Ser. No. 595,990, filed July 14, 1975, in the names of L. E. Contois et al.

Table I lists representative photoconductors that are useful in the practice of this invention.

TABLE I

Tetraphenylethylene
1,4-Diphenyl-1,3-butadiene
1,1,4-Triphenylbutadiene
1,1,4,4-Tetraphenyl-1,3-butadiene
1,2,3,4-Tetraphenyl-1,3-butadiene
1,6-Diphenyl-1,3,5-hexatriene
p-Terphenyl
p-Quaterphenyl
p-Sexiphenyl Photoconductive insulating compositions for use in layers of the element of the present invention include cellulose nitrate. The cellulose nitrate that is used can vary greatly in such factors as molecular weight and nitrogen content. Cellulose nitrates having a nitrogen content of up to about 13 weight percent as shown by elemental analysis are preferred. A wide range of cellulose nitrates, at different viscosities and different nitrogen contents, is available. Many such materials are discussed in *Nitrocellulose, Properties and Uses,* Hercules Powder Co., (1955). The cellulose nitrate should be soluble in a solvent or solvent mixture that has little or no solvent action on the organic photoconductor. Alcohol soluble cellulose nitrate is preferred, such as that which exhibits appropriate solubility in lower alcohols like methanol.

Sensitizers can be included in the present photoconductive insulating compositions. Useful sensitizers include spectral sensitizers, which are intended primarily to make the photoconductor light-sensitive to spectral regions not within the region of its inherent sensitivity; and chemical sensitizers that serve primarily to increase light-sensitivity of the photoconductor in the spectral region of its inherent sensitivity as well as in those regions to which it may have been spectrally-sensitized.

Representative chemical sensitizers include polymeric sensitizers having monovalent side groups of the chlorendate radical, such as polyvinylchlorendate and others described in greater detail in copending U.S. patent application Ser. No. 800,594 entitled POLYMERIC CHEMICAL SENSITIZERS FOR ORGANIC PHOTOCONDUCTIVE COMPOSITIONS by J. M. McCabe et al and filed concurrently herewith; hexachlorocyclopentene chemical sensitizers in combination with cellulose nitrate as described in copending U.S. patent application Ser. No. 800,483 entitled HEXACHLOROCYCLOPENTENE CHEMICAL SENSITIZERS FOR HETEROGENEOUS ORGANIC PHOTOCONDUCTIVE COMPOSITIONS by W. E. Yoerger and filed concurrently herewith; quinoxalines and halogenated quinoxalines like 2,3,6-trichloroquinoxaline and others in combination with cellulose nitrate disclosed in copending U.S. patent application Ser. No. 800,587 entitled $\pi$-DEFICIENT N-HETEROAROMATIC CHEMICAL SENSITIZERS FOR HETEROGENEOUS ORGANIC PHOTOCONDUCTIVE COMPOSITIONS by William E. Yoerger and filed concurrently herewith. Other chemical sensitizers include mineral acid; carboxylic acids such as maleic, di- and trichloroacetic acids, and salicylic acids; sulfonic acids and phosphoric acids; and electron acceptor compounds as disclosed by H. Hoegl in *J. Phys. Chem.,* 69, No. 3, pages 755–766 (March, 1965) and in U.S. Pat. No. 3,232,755.

Spectral sensitizers can be included in the present photoconductive insulating compositions, which are intended primarily to make the photoconductor light-sensitive to spectral regions not within the region of its inherent sensitivity. Spectral sensitizers can be chosen from a wide variety of materials such as pyrylium dye salts inclusive of thiapyrylium and selenapyrylium dye salts such as those described in U.S. Pat. No. 3,250,615 (issued May 10, 1966), the benzopyrylium type sensitizers described in U.S. Pat. No. 3,554,745 (issued Jan. 12, 1971 to J. A. Van Allan); and defensive publication No. T-889,023 (published Aug. 31, 1971 to G. A. Reynolds et al); or the cyanine, merocyanine or azacyanine dyes described in U.S. Pat. No. 3,597,196 (issued Aug. 3, 1971 to C. J. Fox et al).

Preferred spectral sensitizers for use with the present photoconductive compositions include the benzopyrylium dye cation 4-(thiaflavylidylmethylene)-flavylium and/or the cyanine dye cation 1,3-diethyl-2-{2-(2,3,4,5-tetraphenyl-3-pyrrolyl)vinyl}-1H-imidazo{4,5-b}quinoxalinium.

In compositions of the subject type, chemical sensitizers are usually included in an amount of about 0.1% to about 10% by weight of the photoconductor. Spectral sensitizers are usually present in the composition in an amount of about 0.001% to about 0.1% by weight of the photoconductor. Wider ranges can be useful. In the case of spectral sensitizers, however, unduly high concentrations can produce color that is apparent to the eye and change undesirably the appearance of compositions that are intended to provide a white background.

Matting agents are usefully included in the present photoconductive insulating compositions. A matting agent tends to avoid glossiness that might otherwise be obtained in layers prepared using the subject compositions and thereby enhance the "plain paper" appearance and feel that can characterize electrophotographic elements of this invention that use a paper support. Further, matting agents can improve the capability of such layers to receive legibly information written or otherwise marked on the layer. Matting agents are preferably electrically inert and hydrophobic, so as not to interfere with chargeability, charge retention or other parameters affecting electrophotographic imaging. Methacrylate and polyethylene beads are described in U.S. Pat. No. 3,810,759 (issued May 14, 1974 to T. H. Morse et al) as matting agents. Silicon containing materials are described as matting agents in U.S. Pat. No. 3,652,271 (issued Mar. 28, 1972 to D. M. Bornarth). An especially preferred silicon based matting agent is an inorganic oxide pigment, such as fumed silicon dioxide, that has been chemically modified to render it hydrophobic by reaction with an organic compound like a silane to substitute hydrocarbylsilyl or other hydrophobic groups for the hydroxyl groups originally on the silicon dioxide chain. The fumed silica or other inorganic oxide pigment can be reacted conveniently with an appropriate silane, such as a halotrialkylsilane, merely by contact in solution. A preferred silane is chlorotrimethylsilane and incorporation of the silane in an amount of about 5 to about 15% by weight of the inorganic pigment is especially desirable. It is considered that other inorganic pigments like titanium dioxide and aluminum oxide, as well as clays, could be modified similarly by reaction with a silane to provide useful matting agents. Matting agents can be employed in a wide range of particle sizes and concentrations to provide the desired degree of surface texture. It is also well known in the art to consider the thickness of the layer comprising the matting agent when selecting matting agent of a given particle size. See, for example, the aforementioned U.S. Pat. No. 3,652,271, and U.S. Pat. No. 3,519,819, issued July 7, 1970 to E. P. Gramza et al. It should be emphasized that such matting agents can be used to advantage in a wide range of homogeneous and heterogeneous photoconductive insulating compositions.

Photoconductive insulating compositions of the present invention can be prepared merely by dispersing photoconductor having the desired particle dimensions in a solution of the cellulose nitrate that may also contain any other constituents e.g., chemical sensitizers, spectral sensitizers, matting agents, etc., to be included in the composition. As mentioned elsewhere herein, the binder's solvent should not have solvent action with respect to the photoconductor, which desirably is not dissolved or swollen in the presence of the cellulose nitrate solvent. After addition of the particulate photoconductor, the heterogeneous composition is usually stirred or otherwise mixed thoroughly to assure reasonable uniformity of the dispersion. As used herein, photoconductors desirably have a maximum particle diameter ranging from about 0.1 micron to about 20 microns with from about 0.1 micron to about 10 microns being preferred. If the photoconductor has not been ball-milled or otherwise processed to an appropriate particle size prior to its dispersion in the binder, a heterogeneous composition of the invention can be prepared and thereafter agitated in the presence of stainless steel balls or other agent effective to produce a milling action that causes attrition in the particle size of the photoconductor.

In the alternative, the photoconductor can be dispersed and ball-milled in a non-solvent that is a solvent for the cellulose nitrate. Sensitizers to be included in the composition can be added to the photoconductor dispersion prior to such ball-milling. After this first ball-milling stage, the cellulose nitrate can be added, usually in the form of a solution. The composition is preferably again milled to obtain a uniform dispersion.

In the present compositions, the photoconductor is desirably included in an amount of at least about 40% by weight of solids in the composition and may range to 95 weight percent and higher depending on the particular application. The cellulose nitrate, of course, need only be present in sensitizing amounts. However, cellulose nitrate can also serve simultaneously as binder in which case it should be present in an amount sufficient to also provide adhesion between particles in the composition and between the composition and the support, such amount being also sufficient to sensitize the composition. Typically, the cellulose nitrate as binder-sensitizer can be present in the composition from about 5 percent to about 40 percent by weight of solids in the composition. In various preferred embodiments, the photoconductor and any sensitizers, matte agents or other adjuvants constitute between about 70 and 90% by weight of solids in the composition, with the cellulose nitrate making up the remainder of the composition.

As indicated above, the photoconductive insulating composition is usually prepared as a solution of the cellulose nitrate containing other components of the composition including dispersed photoconductive particles. In such form, the composition is coated on an electrically conducting paper support to provide a layer on a coated paper element. For purposes of coating, the compositions desirably range from about 20 weight percent solids to about 40 weight percent solids. If extrusion hopper coating is to be used, the most useful solids content of the composition is usually between about 20 and 30 weight percent. For doctor blade coating, from about 30 to about 40 weight percent solids is preferred. Wider ranges may be appropriate depending on conditions of use. In preparing the compositions for purposes such as ball milling and coating, it may be desirable to use a solvent blend to provide optimal viscosity, ease of solvent removal or the like. Acetonitrile can be desirable in combination with methanol to provide a solvent mixture for the cellulose nitrate binders discussed herein.

While it is preferable to use cellulose nitrate as sole binder with photoconductors described above, it may also be desirably to employ cellulose nitrate in combination with other resins as co-binders in the present compositions. If so desired, cellulose nitrate must be present in a concentration sufficient to increase the photoconductivity of the overall composition having such other resins compared to otherwise identical compositions without cellulose nitrate. (In this regard, cellulose nitrate in amounts covering the surface of the photoconductor particles is considered sufficient). Suitable other resins include conventional film forming materials such as polyesters, polycarbonates and the like.

In applying the photoconductive insulating composition on a surface or support, they can be coated by any suitable means, such as extrusion hopper, doctor blade or whirler coating apparatus, at a coverage sufficient to provide a layer of from 10 to about 25 microns thick when dry, although layers of lesser or greater thickness can be used, if desired. The dry thickness for any given wet thickness as coated will depend in part on the size of the photoconductive particles in the composition and on the amount of void volume, if any, in the layer. Coverages of from about 2 to about 15 grams per square meter of support are often used.

Suitable supporting materials on which can be coated photoconductive layers comprising the photoconductive compositions described herein include any of a wide variety of electrically conducting paper supports, for example, paper (at a relative humidity above 20 percent). Metal layers can be applied to paper supports (typically by vapor deposition) to provide the requisite conductivity to the overall support. Suitable metals include silver, nickel, aluminum, electrically conducting metals intermixed with protective inorganic oxides, such as Cr intermixed with SiO (as described in U.S. Pat. No. 3,880,657 issued Apr. 29, 1975 to A. A. Rasch) and the like.

An especially useful conducting support can be prepared by coating a paper support material with a conducting layer containing a semiconductor dispersed in a resin. Such conducting layers both with and without insulating barrier layers are described in U.S. Pat. No. 3,245,833 by Trevoy, issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk, issued Nov. 7, 1961 and 3,262,807 by Sterman et al, issued July 26, 1966. Another useful support is paper or other fibrous material having thereon, to enhance electrical properties of the support, an electrically conducting material as described in U.S. Pat. No. 3,814,599 (issued June 4, 1974 to D. A. Cree), particularly in Columns 2 and 3 of the patent.

Photoconductive compositions according to the present invention can be employed in coated paper elements useful in any of the well known electrophotographic processes which require photoconductive layers. One such process is the reader-printer copying process. In a process of this type, a coated paper element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed (i.e., either the charged or uncharged areas rendered visible) by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. patents: U.S. Pat. Nos. 3,786,439 by Young, issued Mar. 26, 1957; 2,786,440 by Giaimo, issued Mar. 26, 1957; 2,786,441 by Young, issued Mar. 26, 1957; 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. Techniques of the type indicated are well known in the art and have been described in the literature such as in "RCA Review," Volume 15 (1954), pages 469–484.

Because the electrophotographic elements described herein can be developed in a liquid environment, as above described, the non-photoconductive surface of the elements, i.e. that side of the support opposite the side carrying the photoconductive layer, can be overcoated with a so-called solvent hold-out layer. One or more of these layers serve to reduce or eliminate penetration of solvent or liquid carriers into the paper support during development. A typical hold-out layer can include pigments, pigment dispersing agents, clays, latices such as styrene-butadiene latex, polyvinylalcohol, and the like, in various proportions to give the desired result.

H and D electrical speeds to indicate the photoconductive response of electrophotographic materials such as those discussed herein can be determined as follows: The coated paper is electrostatically charged under, for example, a corona source until the surface potential, as measured by an electrometer probe, reaches some suitable initial value $V_o$, typically from 100 to about 600 volts. The charge element is then exposed to a 3000° K tungsten light source or a 5750° Xenon light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the initial surface potential $V_o$ to any fixed selected value, typically $\frac{1}{2}$ $V_o$. The foregoing procedure was employed in the examples below. An apparatus useful for determining the electrophotographic speeds of photoconductive compositions is described in Robinson et al, U.S. Pat. No. 3,449,658, issued June 10, 1969.

The following examples are included to illustrate the present invention.

EXAMPLES 1-3

Two sets of photoconductive insulating compositions were prepared as follows: the first set included 80 percent photoconductor shown in Table II below (all percentages on a weight basis of total composition unless otherwise stated), 20 percent cellulose nitrate (grade RS ¼ sec supplied as 70 percent solids in isopropanol by Hercules Powder Company), and 0.01% 4-(thiaflavylidylmethylene)flavylium chloride (spectral sensitizer) based on the weight of photoconductor.

Set two compositions were identical to set one except cellulose nitrate was replaced with a poly(methylmethacrylate-co-methacrylic acid 75/25) binder. All compositions were placed in respective vials containing methanol and zirconium oxide milling media and milled by being shaken on a reciprocating paint shaker. The resulting compositions were coated on respective electrically conducting paper supports and dried to a dry coverage of approximately 10.5 grams per square meter, to prepare coated paper electrophotographic elements. Each of the electrophotographic elements was charged to 300 volts (positive polarity) and was thereafter exposed to a 3000° K tungsten light source for a time sufficient to discharge exposed regions to +150 volts. The relative 150 volt electrical speed for each element is shown in Table II, with a speed of 100 arbitrarily assigned to the element comprising p-terphenyl and cellulose nitrate.

TABLE II

| | | Relative Electrical Speed | |
|---|---|---|---|
| Example | Photoconductor | Cellulose Nitrate | Poly(methylmethacrylate-co-methacrylic acid 75/25) |
| 1 | p-terphenyl | 100 | 0 |
| 2 | p-quaterphenyl | 167 | 3.3 |
| 3 | 1,1,4,4-tetraphenyl-1,3-butadiene | 70 | 5 |

Examples 1-3 illustrate from one standpoint the unexpected behavior of heterogeneous organic photoconductor compositions comprising cellulose nitrate. From another standpoint, the unexpected cooperation of cellulose nitrate and particulate organic photoconductor was confirmed by the significantly reduced photoconductive response of homogeneous organic photoconductive compositions containing cellulose nitrate. For example, an electrophotographic element comprising an electrically conducting support and a layer thereon of a homogeneous photoconductive layer including 40 weight percent of the photoconductive material 4,4-bis(diethylamino)-2,2'-dimethyltriphenylmethane sensitized with 2,4-bis(4-ethoxyphenyl)-6-(4-amyloxystyryl)-pyrylium fluoroborate (1.5 weight percent of the photoconductor) and 60 weight percent of a polyester resin binder, Vitel ®101 supplied by Goodyear Tire & Rubber Corporation, was prepared. Charging this element to a potential of 600 volts (positive polarity) and thereafter exposing to 3000° K tungsten light source produced a 100 volt shoulder speed of 100 (arbitrarily selected) and a 100 volt toe speed of 10. Similar elements, but having in the 60 weight percent binder a mixture of the polyester and the aforementioned cellulose nitrate in the following weight ratios—95:5; 90:10; 80:20 and 60:40—produced decreasing relative 100 volt shoulder/100 volt toe speeds of 80/5.4; 54/4; 14/1.8 and 28/0.6 with increasing cellulose nitrate concentration. A similar element, but with 100 percent cellulose nitrate as the binder, produced no response.

The invention has been described in detail with particular reference to certain preferred embodiments thereof, but it will be understood that variations and modifications can be effected within the spirit and scope of the invention.

What is claimed is:

1. An electrophotographic element comprising an electrically conducting paper support bearing a layer of a heterogeneous photoconductive insulating composition comprising particles of an organic photoconductor in admixture with at least a sensitizing amount of cellulose nitrate, said photoconductor being a polyphenyl having at least three para-linked phenyl groups or a compound of the structure:

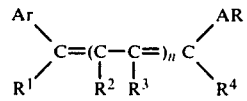

wherein n is 0, 1, or 2

Ar is aryl; and $R^1$, $R^2$, $R^3$ and $R^4$ individually represent hydrogen, Ar, alkyl having 1 to about 10 carbon atoms, or alkoxy having 1 to about 10 carbon atoms, with the proviso that when n is 0, both $R^1$ and $R^4$ are Ar, and when both $R^1$ and $R^4$ are hydrogen, both $R^2$ and $R^3$ are Ar.

2. An electrophotographic element as described in claim 1 wherein said photoconductor is p-terphenyl or p-quaterphenyl.

3. An electrophotographic element as described in claim 1 wherein said photoconductor is p-terphenyl, in a concentration in the range from about 60 to about 95 percent, by weight of said composition, and the nitrogen content of said cellulose nitrate is from about 11.5 to about 13 percent.

4. An electrophotographic element as described in claim 3, wherein said composition additionally comprises a matte agent and a chemical sensitizer.

5. An electrophotographic element as described in claim 1 wherein said composition additionally comprises a cyanine spectral sensitizer or benzopyrylium spectral sensitizer.

6. An electrophotographic element as described in claim 5 wherein said cyanine spectral sensitizer is a 1,3-diethyl-2-{2-(2,3,4,5-tetraphenyl-3-pyrrolyl)vinyl}-1H-imidazo{4,5-b}quinoxalinium salt and said benzothiapyrylium spectral sensitizer is a 4-(thiaflavylidylmethylene)flavylium salt.

7. An electrophotographic element comprising an electrically conducting paper support bearing a layer of a heterogeneous photoconductive insulating composition comprising particles of a polyphenyl organic photoconductor having at least three para-linked phenyl groups, in admixture with at least a sensitizing amount of cellulose nitrate having a nitrogen content from about 11.5 to about 13 percent.

8. An electrophotographic element as described in claim 7 wherein the concentration of said cellulose nitrate in said composition is in the range from about 5 to about 40 percent, by weight of said composition.

9. An electrophotographic element comprising an electrically conducting paper support bearing a layer of a heterogeneous photoconductive insulating composition comprising particles of an organic photoconductor in admixture with at least a sensitizing amount of cellulose nitrate having a nitrogen content from about 11.5 to about 13 percent, said photoconductor being a compound of the structure:

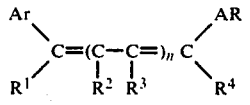

wherein n is 0, 1, or 2

Ar is aryl; and $R^1$, $R^2$, $R^3$ and $R^4$ individually represent hydrogen, Ar, alkyl having 1 to about 10 carbon atoms, or alkoxy having 1 to about 10 carbon atoms, with the proviso that when n is 0, both $R^1$ and $R^4$ are Ar, and when both $R^1$ and $R^4$ are hydrogen, both $R^2$ and $R^3$ are Ar.

10. An electrophotographic element as described in claim 9 wherein n is 0 or 1 and Ar is alkylphenyl having 1 to about 10 carbon atoms in the alkyl moiety, or alkoxyphenyl having 1 to about 10 carbon atoms in the alkoxy moiety.

11. An electrophotographic element as described in claim 9 wherein said organic photoconductor is tetraphenylethylene; 1,4-diphenyl-1,3-butadiene; 1,1,4-triphenylbutadiene; 1,1,4,4-tetraphenyl-1,3-butadiene; 1,2,3,4-tetraphenyl-1,3-butadiene; or 1,6-diphenyl-1,3,5-hexatriene.

12. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 1.

13. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 3.

14. An electrophotographic copy comprising an element as described in claim 1 and a visible image pattern electrophotographically formed and developed on said photoconductive insulating layer.

* * * * *